United States Patent [19]

McLean

[11] 4,261,140

[45] Apr. 14, 1981

[54] SAFETY DOOR FOR NURSERY SCHOOLS, KINDERGARTENS AND LIKE ENVIRONMENTS

[76] Inventor: James C. McLean, 2209 Meadowlark Dr., High Point, N.C. 27260

[21] Appl. No.: 965,571

[22] Filed: Dec. 1, 1978

[51] Int. Cl.[3] ..... E05D 11/00

[52] U.S. Cl. ..... 49/383; 16/83

[58] Field of Search ..... 49/383; 16/83, 86A

[56] References Cited

U.S. PATENT DOCUMENTS

| | | | |
|---|---|---|---|
| 474,633 | 5/1892 | Glazier | 49/383 |
| 1,258,856 | 3/1918 | Beaudette | 16/83 |
| 1,415,493 | 5/1922 | Strayer | 16/86 A |
| 2,686,942 | 8/1954 | Spector | 49/383 |
| 3,827,183 | 8/1974 | Zimmerman et al. | 49/383 |

FOREIGN PATENT DOCUMENTS

| | | | |
|---|---|---|---|
| 2343116 | 9/1977 | France | 49/383 |
| 10831 | of 1892 | United Kingdom | 49/483 |

*Primary Examiner*—Kenneth Downey

[57] ABSTRACT

Protective devices which are attached to a door and the surrounding casing for the purpose of providing maximum protection for the fingers of small children include: (1) a door stop device pivotally mounted on the front surface of the door, adjacent the free or unhinged edge, such that the stop automatically pivots downwardly and outwardly when the door opens to a position between the door and adjacent casing to prevent complete closure of the door until the stop device is reset; (2) a flexible, retractible shield overlying the forward gap between the front edge of the hinged side of the door and adjacent casing sidewall; (3) a flexible shield overlying the rear gap between the rear edge of the hinged side of the door and the casing; and (4) a yieldable, soft member forming a substantial portion of the vertical free edge of the door.

1 Claim, 7 Drawing Figures

SAFETY DOOR FOR NURSERY SCHOOLS, KINDERGARTENS AND LIKE ENVIRONMENTS

BACKGROUND OF THE INVENTION

Prior art relating to the design of doors and surrounding casing structure includes types of door stops as well as various devices and attachments directed to preventing injury to a person who may catch a hand or finger in the door when it is closed.

Examples of such art are found in U.S. Pat. Nos. 4,040,142, 2,686,942, 1,829,312, 2,065,685, 1,258,856, 2,846,713 and 3,800,360. Each of these patents is directed to some type of apparatus which is attached to the door structure as needed at a time after the door is installed in use. Certain of these devices are directed to means for preventing the fingers or hands being caught in the hinged connection between the door and adjacent structure. However, most of these devices are not designed for and do not prevent the fingers getting into the hinged area. Instead, they are primarily directed to preventing the door closing upon the fingers. The patent to Ippolito, U.S. Pat. No. 4,040,142, discloses a bellows-type apparatus installed such that when the door is opened a folding panel extends across the grooved opening formed opposite the hinges such that a hand or fingers cannot be placed therein. However, when the door is not fully but only partially opened, the bellows panel as described will not fully extend and a person may still get a hand or fingers caught therein and pinched between the door and casing. This same deficiency exists in other such devices known to the present applicant.

Apparatus directed simply to a door check is described in U.S. Pat. No. 3,800,360 to Knarreborg. The door check described therein also includes a noise silencing bumper in the form of a pendulous device or bumper which is adapted to momentarily lodge between the door and the casing and then, as the door approaches the final closing stage, the bumper automatically tilts away to land in a neutral position and permit the door to close. This patent and others similar are primarily designated to impede or slow down the closing of a door rather than fully prevent the closing.

Other patents, including the above cited U.S. Pat. No. 2,686,942, disclose the positioning of a resilient bumper or guard along the casing or jamb adjacent the free edge of the door to reduce injury to extremities caught therein. However, these devices as disclosed do not overlie an adequate surface area to completely prevent injury. As generally described these guards are installed in an intermediate area of the jamb to engage the door edge when in a closed position. Therefore, it is quite possible to pinch a hand or finger between the door edge and an unpadded area of the jamb.

Examples of finger injury preventive devices for car doors are shown in U.S. Pat. Nos. 2,065,685 and 1,829,312; however, they are both considered to be partially or totally ineffective in a substantial number of cases.

The above problems are particularly significant in an environment where young children are present such as in daycare centers and nurseries. In such an environment it is desirable to have doors which are specifically designed to prevent injury to a child should the hands or fingers be caught in either the hinged edge or free edge of the door structure.

SUMMARY OF THE PRESENT INVENTION

A safety door and surrounding casing or jamb have been designed primarily for use in an area where small children are present. The door structure features multiple safety features which cooperatively interact to significantly reduce and hopefully eliminate the likelihood of injury to a child by the normal operation of the door.

Specifically the safety elements on the door are designed to: (1) prevent the placement of hands or fingers in the front or rear hinged area of the door and casing when the door is opened to any degree; and (2) prevent the hands or fingers from being pinched between the free edge of the door and adjacent casing by preventing closure thereof or even if the door closes completely.

The door structure as taught by a preferred embodiment includes a conventional door and surrounding casing with the door having one vertical side hingedly connected to the adjacent side wall of the casing. The safety elements function to protect a child positioned adjacent either face of the door, and include flexible panels which overlie and shield the inner and outer gaps (to the front or rear of the door respectively) formed between the open door and casing at the hinged side; and a free side protective means which may be either a pivotally mounted door stop which is selectively set in a tilted position such that it automatically falls downwardly to extend between the free edge of the door and the adjacent casing wall when the door is opened; or a soft edge along a significant portion of the free edge of the door whereby the hard portion of the door panel cannot pinch the fingers or hand when closed.

The shield means for the front and rear faces of the hinged side of the door overlie and conceal the gap between the door and casing to prevent the insertion of hands or fingers thereinto regardless of the degree to which the door is opened. The first shield means includes a panel of flexible sheet material mounted on what will be considered the forward or inner face of the door structure. One lateral edge is fixedly attached to the closure strip of the casing and the panel extends laterally across the gap therebetween to a point where the opposing lateral edge is held in slidable relationship to the front surface of the door. As the door is opened and swung rearwardly the inner or front door edge will slide relative to and concealed by the shield so the shield will extend across the gap. As the door closes the shield will slide laterally toward the center of the door; at all times during operation of the door, remaining in a position overlying the gap.

The second or rearward shield comprises a vertically elongated, relatively narrow panel of flexible sheet material fastened along one vertical edge to the rear surface of the casing, and along the opposing edge to the rear surface of the door. The shield is of a width sufficient to cover the rearward gap. When the door is opened the shield flexes or bends against itself so as not to impede operation of the door.

In a preferred embodiment both the front and rear shields extend vertically substantially the height of the door structure except for the area covered by the hinges on the rear side. Thus it would be highly improbably that a child of any age or stature could injure a hand or finger therein.

The aforementioned door stop or checking device is mounted, in the preferred embodiment, on the inner surface of the door adjacent the upper portion of the free side. The actual stopping element is pivotally mounted so that when in a preset "cocked" position it will, upon opening of the door, automatically fall downwardly by gravity toward and beyond the unhinged edge of the door to lie between the door edge and the casing wall, thus preventing complete closure of the door. The portion of the pivotal stop or bumper which engages the casing wall has a thickness of approximately 1½ to 2 inches. Therefore when the stop falls the door will be stopped far enough from the casing wall to prevent injury to a child if the hands or fingers are inserted therein.

An additional protective element along the unhinged edge of the door which may be provided as supplemental or alternatively to the stop described above is the aforementioned soft edge or cushion which extends along a substantial portion of the free edge of the door. The cushioned portion of the free edge comprises a strip of flexible, soft and extremely yieldable material, such as foam with a protective covering, having a thickness substantially equal to that of the door. The cushioning material is emplaced along a cutout portion of the door edge such that it engages the casing wall when the door is closed. The width of the bumper should be such that it extends a distance into the door sufficient to clear the casing wall at the point of engagement with the door. Preferably the width is approximately 1½ to 2 inches inwardly from the casing wall which is considered adequate to prevent injury regardless of the angle or position at which a finger or hand is caught between the door and casing. The resilient bumper will yield sufficiently as to prevent injury to a child if the door closes completely.

It is therefore an object of the present invention to:

1. provide a safety door for use in an environment where children are primarily present;
2. provide door safety means to prevent catching a hand or fingers in the hinged connection between the door and casing;
3. provide door safety means to prevent pinching a hand or finger between the unhinged edge of the door and casing when the door closes; and
4. selectively prevent complete inadvertent closure of the door.

These and other objects and advantages will become apparent to those skilled in the art as the following detailed description is studied in conjunction with the attached drawings of which:

FIG. 1 is an elevation view of the present invention according to a preferred embodiment;

FIGS. 2 and 2*a* are enlarged perspective view of the portion of the door that includes the stop in the cocked and blocking positions respectively;

FIG. 3 is an enlarged perspective view of the upper inner portion of the door showing the first shield thereon;

FIG. 3*a* is a sectional view taken substantially along lines 3*a*—3*a* of FIG. 4;

FIG. 4 is an enlarged perspective view of the upper portion of the rear side of the door; and FIG. 5 is an enlarged sectional view taken substantially along lines 5—5 in FIG. 1.

DETAILED DESCRIPTION OF A PREFERRED EMBODIMENT

Figure 1:
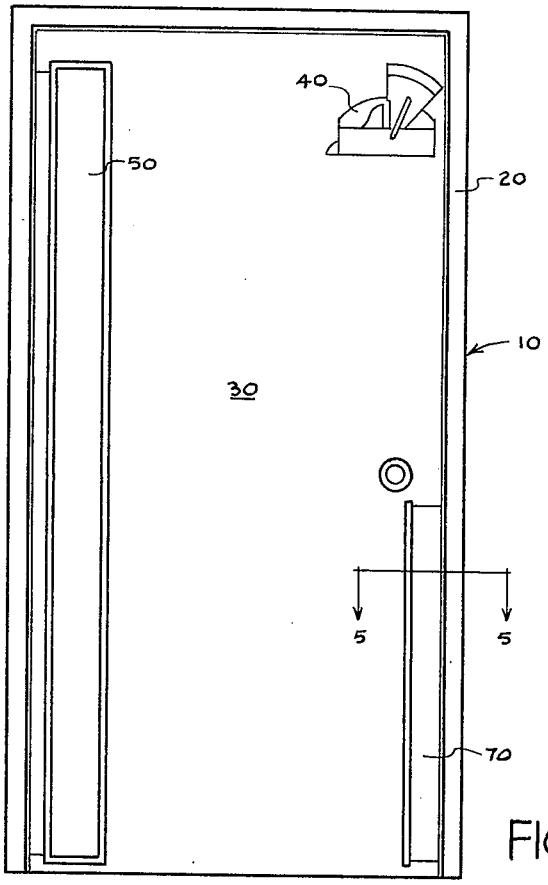

Referring now to FIG. 1 the door structure 10 comprises a frame or casing 20 and a door 30 hingedly attached thereto. The structure 10 is basically of a conventional type wherein the door 30 may be hinged on either vertical edge to the casing 20. Specifically, the preferred embodiment of the structure 10 is designed for use primarily in a nursery, day school or other environment where relatively young children are predominant.

As illustrated in FIG. 1, door 10 includes various protective devices which include door stop or checking means 40, a first or inner gap shielding means 50, second or rear gap shielding means 60, and a soft edge member 70. Each is discussed in detail below.

Figure 2:
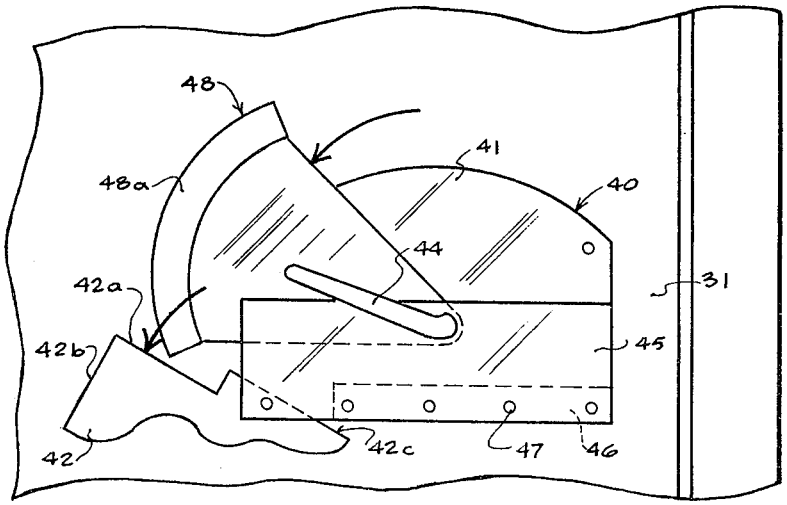
Figure 2A:
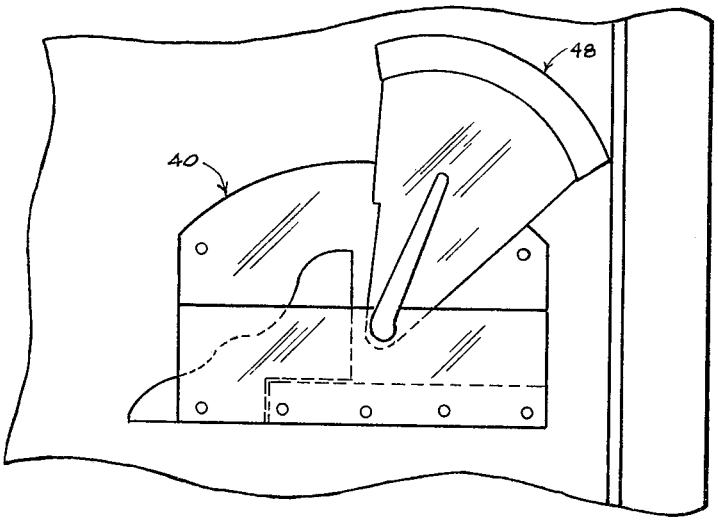

FIG. 2 is illustrative of the door checking means 40 which, in the preferred embodiment, is mounted in the upper right quardrant of the forward surface of the door 30. If the door were hinged on the right vertical edge it is obvious that the checking means 40 would be mounted on the left quadrant. The checking means 40 comprises a back plate 41 secured to the door surface and a front plate 45 secured in spaced arrangement to back plate 41 by means of a spacer bar 46 (shown in dotted lines in FIG. 2). As shown in FIG. 2 back plate 41, front plate 45, and spacer bar 46 are secured together by means of a plurality of screws or fasteners 47. A checking element 48 is pivotally mounted on a shaft between back plate 41 and front plate 45. Spacer bar 46 is cut away at the left end and a stop plate 42 is pivotally mounted between back plate 41 and front plate 45 on the extreme leftmost screw 47. In the uncocked position shown by the solid lines in FIG. 2 the surface 42*a* of the stop plate 42 keeps the checking element 48 from rotating too far in a counterclockwise direction. Stop plate 42 cannot rotate any further in a counterclockwise direction because surface 42*c* strikes the lower left hand corner of spacer bar 46. When stop plate 42 is rotated clockwise to the cocked position (FIG. 1) determined by engagement of surface 42*a* with the upper edge of spacer bar 46, surface 42*b* maintains checking element 48 in such a position that the center of gravity is to the right of the pivot point of checking element 48. So arranged, when the door 30 is opened, the checking element 48 falls by gravity to the obstructing position so that inadvertent closure of the door is impossible. The checking element 48 should be positioned closely enough to the free unhinged edge of the door 30 that it rests tilted against the door casing. When the door is pushed open the checking element 48 will tilt downwardly to a position resting between the door and the casing. A flange 48*a* is attached along the top edge of the checking element 48 extending outwardly therefrom, to provide a safe distance between the door and the casing when the stop lies therebetween. The depth of the flange is a matter of choice but should be sufficient to ensure that a child of any age or size cannot catch a hand or fingers therein. On the preferred embodiment the flange is approximately 1½ inches deep and the door will therefore be approximately that distance from the casing side wall when the door closure is checked.

When it is desirable to permit unimpeded closure of the door 30 as when no children are around, as illustrated in FIG. 2 stop plate 42 is rotated to the counterclockwise position wherein the checking element 48 is retained to the uncocked or deactivated position away from the door edge 31.

As mentioned hereinabove, both the stop plate 42 and the checking element 48 are pivotally mounted. The pivotal connections between the checking element 48 and handle 44 and between the stop plate 42 and back plate 41 are concealed in the preferred embodiment by the front cover plate 45. The front cover plate 45 shields the pivotal mechanism of elements 42 and 48 in the preferred embodiment but it is obvious that it is not essential to the utility of the invention.

Figure 3:
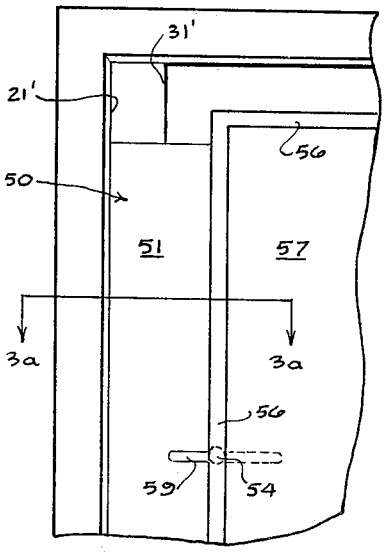
Figure 3A:
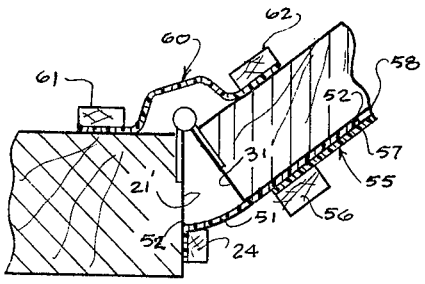

FIGS. 3 and 3*a* illustrate in detail the first or forward inner gap shielding means 50 extending over the gap between the door edge 31' and the casing side wall 21'. The shield 50 comprises a generally rectangular panel 51 formed of a sheet of relatively stiff, but slightly flexible material such as heavy vinyl or polyvinyl stock. In the preferred embodiment one vertical edge 52 is securely fastened to the sidewall 21' and closure strip 24 of the casing. The opposite vertical edge 52' of the shield 50 is, in the preferred embodiment, slidably mounted behind a retaining means 55 on the front surface of the door near the hinged edge. The retaining means 55 as illustrated is a box-type receptacle formed of stock molding strips 56 overlying a stationary face panel 57, all of which are spaced slightly away from the door surface to form a channel 58 through which the shield 50 slides. When the door 30 is opened the shield 50 slides with respect to the retainer 55 to extend over the gap between the door and casing. As the door is closed, the shield 50 slides forwardly into the retainer 55. A plurality of slots 59 are cut into an intermediate portion of the panel 51 and are slidably mounted over retaining pins 54 which extend through strips 56 and into door 30 to prevent the panel 51 from slipping completely out of the retainer 55. The slots 59 are cut to a length sufficient to allow the door to open fully without being impeded by the shield panel 51.

Figure 4:
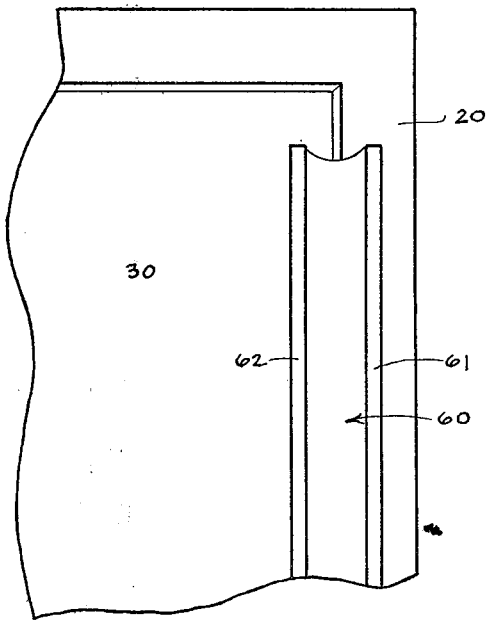

The second or rearward shield means 60 illustrated in FIG. 4 comprises a flexible panel of sheet material such as used for the front shield 50. The shield 60 is a generally rectangular vertically elongated panel fixedly attached along one vertical edge 61 to the casing sidewall, and along the opposite vertical edge 62 to the rear surface of the door adjacent the hinged edge.

Figure 5:
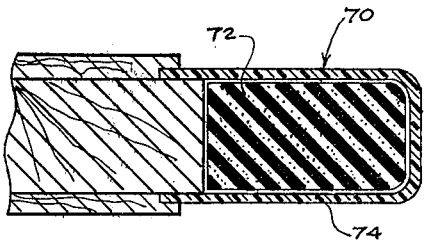

As an alternative approach to the checking device 40 the soft edge member 70 (FIG. 5) comprises an elongated portion of very soft rubber or plastic material insert along a substantial portion of the unhinged edge of the door. Although not limited to such height, the soft member 70 in the preferred embodiment extends downwardly at least from the door knob 80 to the lower edge of the door. To install the member 70, a selected portion of the door edge 31 is cut away and the member 70 mounted therein. The member 70 is formed of any inner piece 72 of foam material and a protective covering 74 of flexible plastic or textile material, attached at the edges to door 30. While foam is presently contemplated, it should be recognized that other materials such as rubber, or a hollow yieldable cap might be used with or without a protective covering. The soft edge 70 should be of approximately the same thickness and height dimensions as the edge portion removed from the door. When properly mounted the soft edge will significantly reduce the chances of injury due to catching a hand between the door and casing wall. From any angle a hand or finger may be extracted from between the yieldable bumper 70 and the casing wall 21. It is merely a matter of pushing the bumper aside and withdrawing the hand without injury.

The checking means 40 and the soft edge member 70 are both considered to be free side protective means for preventing closure of at least a major portion of the free side of the door panel against the casing 20. Therefore both are for the purpose of preventing injury when catching a hand or fingers between the free door side 31 and casing wall 21. Therefore ordinarily only one of those devices would be installed on the same door as they are alternative approaches. However, for illustrative purposes the door in FIG. 1 is shown with both devices 40 and 70 mounted thereon.

While a preferred embodiment of the present invention has been described herein other and further modifications may be made without department from the scope of the claims outlined below.

What is claimed is:

1. In combination with a door structure of the type including a casing or frame surrounding a door panel which is hinged along one side leaving the other side free to open and close, said door structure adapted for use in nurseries, kindergartens and the like, and including a plurality of protective devices therein including:

(a) a first shield means for covering the inner gap between the forward edge of the hinged side of the door and the casing, said first shield means comprising a vertically elongated, relatively stiff, but slightly flexible panel member having one lateral edge fixedly attached to said casing wall, a pocket means positioned on the inner surface of said door panel for retaining the opposite lateral edge of said flexible panel slidably within said pocket means, with the central area of the elongated panel covering said inner gap at all times during opening and closing of the door;

(b) a second shield means for covering the outer gap between the rear edge of the hinged side of the door and the casing, said second shield means comprising a vertically elongated, substantially flexible panel member having one lateral edge fixedly attached adjacent to the rear edge of the hinged side of the door and the opposite lateral edge attached to the door casing, the central portion of said panel member covering said outer gap at all times during opening and closing of the door;

(c) a free side protective means for preventing inadvertent closure of the free side of the door against the door casing;

(d) said free side protective means comprising a door stop means mounted to the front or inner surface of said door adjacent the upper portion of the free side thereof, said stop means including a checking element pivotally connected thereto for movement between a first cocked position and a second blocking position between the free side of the door and the casing;

(e) said checking element including a freely swinging member pivotally attached at one end about a pivot shaft, the center of said gravity in said cocked position being located above and toward the free side of said door from said pivot shaft and the edge of said swinging member resting against said casing whereby, upon opening of said door, said checking element drops to its second blocking position.

* * * * *